US005174446A

United States Patent [19]

Czopor, Jr.

[11] Patent Number: 5,174,446

[45] Date of Patent: Dec. 29, 1992

[54] COMBINATION SQUARE PACKAGE AND SLEEVE THEREFOR

[75] Inventor: Edmund J. Czopor, Jr., Burlington, Conn.

[73] Assignee: The Stanley Works, New Britain, Conn.

[21] Appl. No.: 750,186

[22] Filed: Aug. 26, 1991

[51] Int. Cl.[5] ..... B65D 85/20

[52] U.S. Cl. ..... 206/371; 206/45.14; 206/349; 206/477; 206/491

[58] Field of Search ..... 206/45.14, 371, 472, 206/475, 476, 477, 491, 349, 806

[56] References Cited

U.S. PATENT DOCUMENTS

| | | | |
|---|---|---|---|
| 1,493,314 | 5/1924 | Zdrodowski . | |
| 2,439,568 | 4/1948 | Hall . | |
| 2,708,029 | 5/1955 | Kahn | 206/349 |
| 2,953,246 | 9/1960 | Purington . | |
| 3,841,478 | 10/1974 | Wells et al. . | |
| 4,049,120 | 9/1977 | Bower | 206/491 X |
| 4,053,050 | 10/1977 | Forbes, Jr. et al. | 206/476 X |
| 4,171,050 | 10/1979 | Murray et al. . | |
| 4,266,661 | 5/1981 | Dixon et al. . | |
| 4,406,251 | 9/1977 | Bruml | 206/476 X |
| 4,445,610 | 5/1984 | Richards . | |
| 4,496,045 | 1/1985 | Ferguson et al. | 206/476 X |
| 4,496,047 | 1/1985 | Gatley . | |
| 5,020,660 | 6/1991 | Akerly et al. | 206/45.14 |

FOREIGN PATENT DOCUMENTS

| | | | |
|---|---|---|---|
| 695166 | 10/1964 | Canada | 206/349 |

*Primary Examiner*—Bryon P. Gehman

[57] ABSTRACT

A display package containing a combination square or the like having an elongated blade seated in a body member extending at a right angle thereto includes a sleeve comprising a paperboard member substantially symmetrical about a center line and folded along the center line to provide a pair of similarly configured panels. Each panel has a web portion extending along the fold line and a pair of leg portions extending from and spaced apart along the web portion to provide a channel therebetween. The leg portions in one of the panels have slits therein extending inwardly from a side edge thereof substantially parallel to the fold line so that a portion of the leg portions below the slits engages the bottom edge of the blade of the square seated in the sleeve. The opposed pairs of leg portions are secured together below the slits, and this retains a combination square of the like with the elongated blade seated in the elongated web portion and its body portion seated in the channel between the leg portions.

15 Claims, 2 Drawing Sheets

COMBINATION SQUARE PACKAGE AND SLEEVE THEREFOR

BACKGROUND OF THE INVENTION

The present invention relates to display packages, and more particularly, to display packages containing squares and the like.

As is well known, it is generally desirable to provide point of purchase display packages which will allow viewing of the principal elements of the products being displayed and which will also provide surfaces upon which the manufacturer's identification, promotional statements, and instructions may be imprinted. It is also desirable that point of purchase display packages be reasonably rugged so that they will permit the articles contained therein to be supported fully when hung or otherwise suspended on hangers or hooks on perforated display boards and the like. This is particularly true in connection with the display of small hand tools.

Among such hand tools are squares of the type which have an elongated blade which is slidably seated in a body member. Trysquares utilize the surfaces of the body member in conjunction with the blade to determine angular relationships between the blade and the workpiece. Some combination squares have relatively complex configurations for the body member so that surfaces are disposed at various angles, and they may additionally include level vials and other components which may be useful to the artisan or the home owner.

As will also be appreciated, it is also desirable to provide such packaging which is reasonably economical and which may be readily assembled about the product to provide a secure support for the article which is to be displayed in the package.

It is an object of the present invention to provide a novel display package of squares and the like which may be assembled relatively quickly and which utilizes a display sleeve which will securely retain the square therein.

It is also an object to provide such a display package which is readily adaptable to squares with body members of various configuration.

Another object is to provide a paperboard sleeve which may be fabricated and assembled readily and which is relatively economical to fabricate.

SUMMARY OF THE INVENTION

It has now been found that the foregoing and related objects may be readily attained in a display sleeve for combination squares and the like having an elongated blade seated in a body member extending at a right angle thereto. The sleeve includes a paperboard member which is substantially symmetrical about a center line and along which it is folded to provide a pair of similarly configured panels. Each panel has a web portion extending along the fold line and a pair of leg portions extending from and spaced apart along the web portion to provide a channel therebetween.

The leg portions in one of the panels have slits therein extruding inwardly from a side edge thereof substantially parallel to the fold line, and a portion of the leg portions below the slits is engageable below the bottom edge of the blade of a square seated in the sleeve. Opposed pairs of the leg portions are secured together below the slits by suitable securing means. As a result, a combination square or the like may be retained in the sleeve with the elongated blade seated in the elongated web portion and the body portion seated in the channel between the leg portions.

Preferably, the securing means includes adhesive on one opposed pair of the leg portions and at least one fastener in the other opposed pair of the leg portions. The adhesive may comprise a multiplicity of stripes extending transversely of the one opposed pair of leg portions, and the fastener may be a staple.

The slits are disposed in one of each opposed pair of leg portions and have a generally L-shaped configuration to provide hinged tabs. The securing means is disposed closely adjacent the slits.

Desirably, the panels have aligned apertures therein for hanging the sleeve on a hook or the like, and one of the leg portions is of lesser length than the other leg portion in the direction perpendicular to the fold line.

DETAILED DESCRIPTION OF THE PREFERRED EMBODIMENTS

Figure 3:
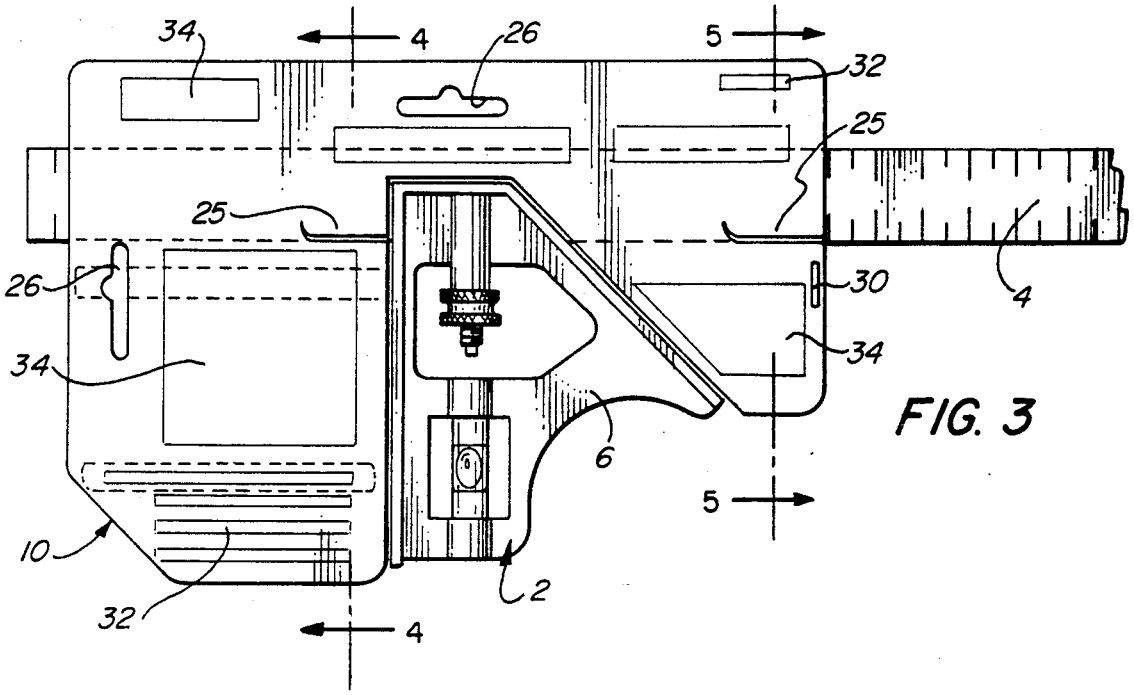
FIG. 3 is a plan view of a display package embodying the present invention with the blade of the combination square fragmentarily illustrated.

Turning first to FIG. 3, therein illustrated is a display package containing a combination square and embodying the present invention. The package comprises a square, generally designated by the numeral 2, having an elongated blade 4 which is slidably seated in the body 6, which is of generally conventional construction. The square 2 is seated in a paperboard sleeve generally designated by the numeral 10.

Figure 1:
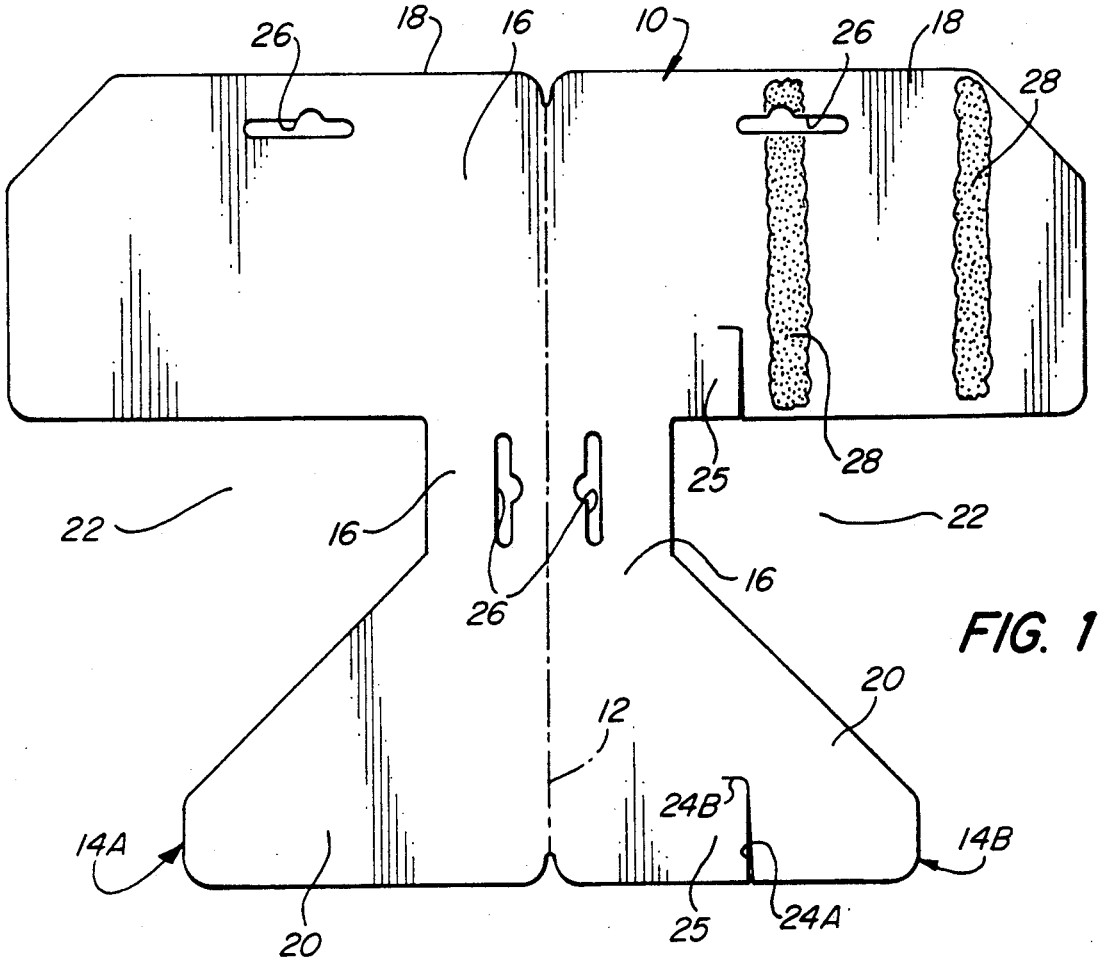
FIG. 1 is a plan view of an unfolded sleeve utilized in the display package of the present invention.
Figure 2:
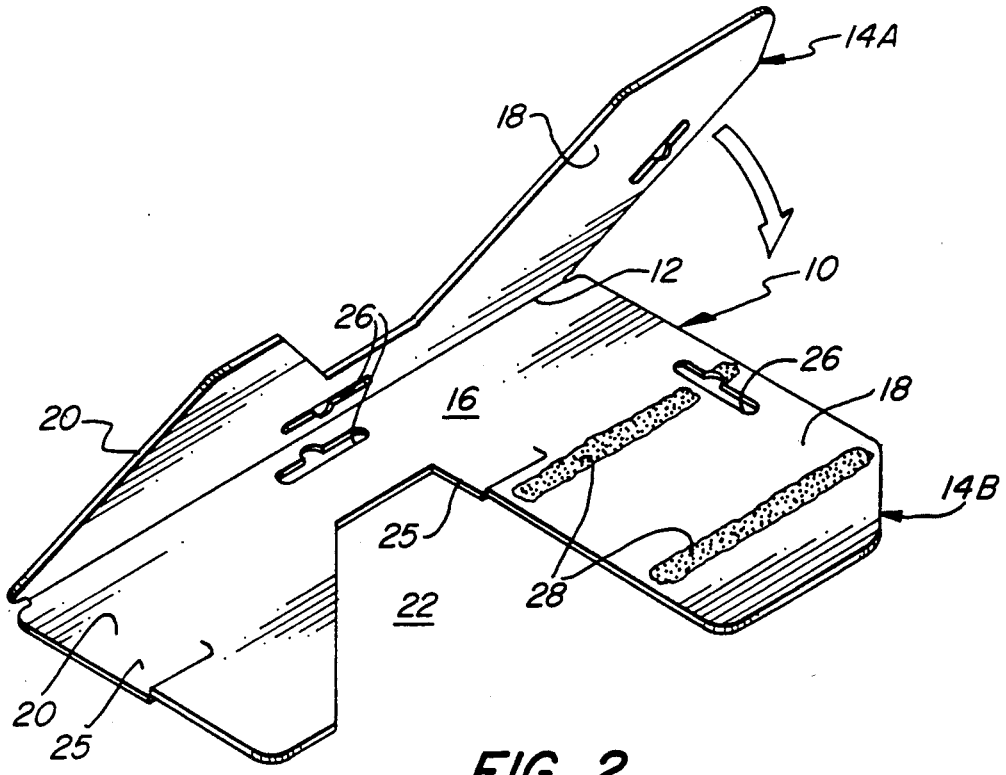
FIG. 2 is a perspective view thereof showing one of the panels of the sleeve in the process of being folded over the other panel for engagement therewith.

As seen in FIGS. 1 and 2, the sleeve 10 is symmetrical about a fold line 12 extending longitudinally thereof and the fold line 12 results in a pair of substantially identically configured panels generally designated by the numerals 14A and 14B, each having a web portion 16 extending along the length of the fold line 12 and a pair of leg portions 18, 20 which are spaced apart along the web portion 16 and thereby provide a channel 22 therebetween.

The leg portions 18, 20 of the panel 14B have generally L-shaped slits 24 extending inwardly from one side edge thereof with a long portion 24A parallel to the fold line 12 and a relatively short portion 24B extending perpendicularly from the inner edge thereof and away from the fold line 12, thereby produce a hinged tab 25.

The leg portions 18 of both panels and the web portions 16 of both panels have aligned hang holes 26 therein. The leg portion 18 of the panel 14B is provided with a pair of adhesive stripes 28 below the slit 14, and these secure the opposed pair of leg portions 18 of the two panels 14A, 14B together.

As simulated in FIG. 3, the exposed surface of paperboard sleeve 10 is imprinted with text lines generally designated by the numeral 32 and with illustrations generally indicated by the blocks 34, as is conventional with display cards of this type.

When the paperboard sleeve 10 is assembled with the square 2, the blade 4 extends in part between the web portions 16 of the two panels 10 and in part between the leg portions 18, 20 of the two panels above the longer leg 24A of the slits 24. The tab portion 25 of the panel 14B are deflected outwardly by the thickness of the blade 4, and the edges of the leg portions 18, 20 below the slits 24A abut the edge of the blade 4 to position it thereabove.

Figure 4:
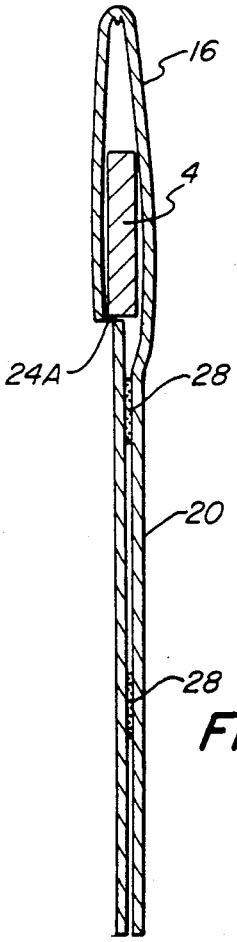
FIG. 4 is a sectional view drawn to an enlarged scale of the package of FIG. 3 along the line 4—4 thereof.
Figure 5:
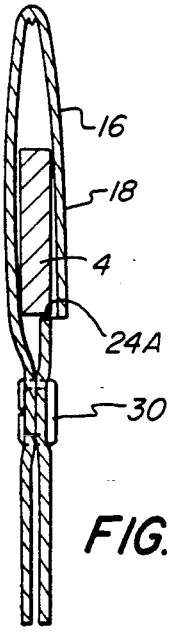
FIG. 5 is a sectional view drawn to an enlarged scale of the package of FIG. 3 along the line 4—4 thereof.

As can be seen in FIGS. 4 and 5, the adhesive stripes 28 secure the panels 14A, 14B together in the area of the leg portions 18 and a staple 30 secures the leg portions 20 in assembly. As can be seen, the staple 30 is located closely adjacent, but below, the slit 24.

In assembling the package, the sleeve 10 is initially folded over and has its leg portions 18 bonded together by the adhesive stripes 28. The folded sleeve 10 is positioned so that one protruding end of the blade 4 is introduced into the space between the panels 10A and 10B at the upper ends of the leg portions 18 above the slit 25. Because the leg portions 20 are still free, they may be spread apart to allow the blade 4 and the body 6 of the square 2 to pass therebetween until the body 4 seat in the channel 22 between the leg portions 18, 20. When the body 6 is fully seated between the leg portions 18, 20, the blade 4 is disposed above the slit 24 in the leg portion 20. With the square 2 so located, the staple 30 is engaged in the overlapping leg portions 20 to secure the square in position.

The thickness of the blade 4 deflects the tabs 25 outwardly and the bottom edge of the blade 4 abuts the edge of the leg portions 18, 20 defining the slit 24.

As can be seen, the display package may be hung from a hanger or hook on a perforated display board or the like, either horizontally or vertically, and the square will be firmly retained therein in either orientation.

Although the illustrated embodiment uses a combination square which has body portion with an angularly disposed side surface, the body of the square may have any configuration, and the leg portions and the channel therebetween are cooperatively configured to seat a major portion of the body so as to firmly retain it in the channel therebetween.

Moreover, although the illustrated embodiment has one leg portion of shorter length than the other, it will be appreciated that both may be of the same length if so desired.

The adhesive utilized to secure the one opposed pair of leg portions may be disposed over the entire surface rather than in the form of stripes as indicated. This adhesive may be applied as a solvent based system, a heat activated system, or as a double coated step, or any other adhesive composition which will exhibit the desired shear strength. Although a staple has been shown as the fastening element for the other opposed pair of leg portions, other types of mechanical fasteners may also be employed.

Thus, it can be seen from the foregoing detailed description and the attached drawings that the display package of the present invention is one in which a square or the like is firmly retained in a novel display sleeve. The construction of the sleeve enables it to be assembled quickly with the square to provide a package in which the square may be substantially exposed and supported at a point of purchase display in either a vertical or a horizontal position. The sleeve may be fabricated readily and relatively economically, and the process of assembling the package is one which may be conducted quickly and with a minimum amount of effort.

Having thus described the invention, what is claimed is:

1. A display sleeve for a combination square having an elongated blade seated in a body member and extending at a right angle thereto, said sleeve comprising:

(a) a paperboard member substantially symmetrical about a center line and folded along said center line to provide a pair of similarly configured overlying panels, each of said overlying panels having an elongated web portion extending along said fold line and a pair of elongated leg portions extending from and spaced apart along said web portion to provide an elongated channel therebetween, each of said leg portions in one of said panels having a slit therein extending inwardly from a side edge thereof substantially parallel to said fold line to provide adjacent leg portions adjacent said fold line and remote leg portions on the opposite side of said slits whereby said remote leg portions may engage and support the bottom edge of the blade of a square seated in said sleeve; and (b) securing means securing opposed pairs of said remote leg portions together, whereby a combination square may be retained therein with the elongated blade seated in said elongated web portion and on said remote leg portions adjacent said slits and with the body member seated in the channel between said leg portions of said panels.

2. The display sleeve in accordance with claim 1 wherein said securing means includes adhesive on one opposed pair of said leg portions and at least one fastener in the other opposed pair of said leg portions.

3. The display sleeve in accordance with claim 2 where said adhesive comprises a multiplicity of stripes extending transversely of said one opposed pair of leg portions.

4. The display sleeve in accordance with claim 2 wherein said fastener is a staple.

5. The display sleeve in accordance with claim 1 wherein said slits are disposed in one of each pair of leg portions and have a generally L-shaped configuration to provide hinged tabs.

6. The display sleeve in accordance with claim 5 wherein said securing means is disposed closely adjacent said slits.

7. The display sleeve in accordance with claim 1 wherein said panels have aligned apertures therein for hanging said sleeve on a hook.

8. The display sleeve in accordance with claim 1 wherein one of said leg portions is of lesser length than the other leg portion in the direction perpendicular to the fold line.

9. The display sleeve in accordance with claim 8 wherein said securing means includes adhesive on one opposed pair of said leg portions and at least one fastener in the other opposed pair of said leg portions.

10. The display sleeve in accordance with claim 9 wherein said fastener is a staple.

11. A display package comprising:

(a) a square having a body member and an elongated blade seated in said body member and extending at a right angle thereto; and (b) a sleeve about said square and comprising:

(i) a paperboard member substantially symmetrical about a center line and folded along said center line to provide a pair of similarly configured overlying panels, each of said overlying panels having an elongated web portion extending along said fold line and a pair of elongated leg portions extending from and spaced apart along said web portion to provide an elongated channel therebetween, each of said leg portions of one of said panels having a slit therein extending inwardly from a side edge thereof substantially parallel to said fold line to provide adjacent leg portions adjacent said fold line and remote leg portions on the opposite side of said slits, said elongated blade of said square being seated in said elongated web portion above said slits and said body portion thereof being seated in said channel between said leg portions; and (ii) securing means securing opposed pairs of said remote leg portions together, the edges of said remote leg portions adjacent said slits engaging and supporting the edge of said blade, and said leg portions limiting longitudinal movement of said body portion received in said channel therebetween.

12. The display package in accordance with claim 11 wherein said securing means includes adhesive on one opposed pair of said leg portions and at least one fastener in the other opposed pair of said leg portions.

13. The display package in accordance with claim 12 where said adhesive comprises a multiplicity of stripes extending transversely of said one opposed pair of leg portions, and said fastener is a staple.

14. The display sleeve in accordance with claim 11 wherein said slits are disposed in one of each pair of leg portions and have a generally L-shaped configuration to provide hinged tabs in said adjacent leg portions which are deflected outwardly by said blade and wherein said securing means is disposed closely adjacent said slits.

15. The display package in accordance with claim 11 wherein said panels have aligned apertures therein for hanging said sleeve on a hook.

* * * * *